US009023771B2

(12) United States Patent
Mabuchi et al.

(10) Patent No.: US 9,023,771 B2
(45) Date of Patent: May 5, 2015

(54) NANOPARTICLE-CONTAINING LUBRICATING OIL COMPOSITIONS

(75) Inventors: Yutaka Mabuchi, Yokohama (JP); Akira Nakagawa, Sagamihara (JP)

(73) Assignee: Nissan Motor Co., Ltd., Kanagawa (JP)

( * ) Notice: Subject to any disclaimer, the term of this patent is extended or adjusted under 35 U.S.C. 154(b) by 399 days.

(21) Appl. No.: 12/162,695

(22) PCT Filed: Jul. 27, 2006

(86) PCT No.: PCT/JP2006/314845

§ 371 (c)(1),
(2), (4) Date: Jul. 30, 2008

(87) PCT Pub. No.: WO2007/088649

PCT Pub. Date: Aug. 9, 2007

(65) Prior Publication Data

US 2009/0018037 A1 Jan. 15, 2009

(30) Foreign Application Priority Data

Jan. 31, 2006 (JP) ..... 2006-022268

(51) Int. Cl.
*C10M 161/00* (2006.01)
*C10M 171/06* (2006.01)
(Continued)

(52) U.S. Cl.
CPC ..... *C10M 171/06* (2013.01); *C10M 141/00* (2013.01); *C10M 129/95* (2013.01); *C10M 141/02* (2013.01); *C10M 145/24* (2013.01); *C10M 161/00* (2013.01); *C10M 129/68* (2013.01); *C10M 153/00* (2013.01);
(Continued)

(58) Field of Classification Search
USPC ..... 508/154, 165, 429, 577
See application file for complete search history.

(56) References Cited

U.S. PATENT DOCUMENTS 3,567,636 A * 3/1971 Katzenstein ..... 508/431
4,946,612 A * 8/1990 Kanamori et al. ..... 508/242
(Continued)

FOREIGN PATENT DOCUMENTS

CN 1419955 5/2003
CN 1468294 1/2004
(Continued)

OTHER PUBLICATIONS

Japanese Industrial Standard, "Chromium Molybdenum Steels," JIS G 4105, 1979, pp. 1-11.
(Continued)

*Primary Examiner* — Taiwo Oladapo
(74) *Attorney, Agent, or Firm* — Foley & Lardner LLP

(57) ABSTRACT

[Object] To provide a nanoparticle-containing lubricating oil composition which demonstrates a low friction coefficient and realizes a further fuel economy.
[Solving Means] A nanoparticle-containing lubricating oil composition comprising a base oil, an additive having hydroxyl group, and nanoparticle. A nanoparticle-containing lubricating oil composition comprising a base oil, an ashless friction modifier having hydroxyl group, and nanoparticle. A nanoparticle-containing lubricating oil composition comprising a base oil, an additive having hydroxyl group, and nanoparticle having a particle diameter of 1 to 100 nm. A nanoparticle-containing lubricating oil composition comprising a base oil, an ashless friction modifier having hydroxyl group, and nanoparticle having a particle diameter of 1 to 100 nm.

4 Claims, 1 Drawing Sheet

(51) Int. Cl.

| | |
|---|---|
| ***C10M 169/04*** | (2006.01) |
| *C10M 141/00* | (2006.01) |
| *C10M 129/95* | (2006.01) |
| *C10M 141/02* | (2006.01) |
| *C10M 145/24* | (2006.01) |
| *C10M 129/68* | (2006.01) |
| *C10M 153/00* | (2006.01) |

(52) U.S. Cl.

CPC ..... *C10M169/04* (2013.01); *C10M 2201/041* (2013.01); *C10M 2201/061* (2013.01); *C10M 2201/062* (2013.01); *C10M 2205/0285* (2013.01); *C10M 2207/003* (2013.01); *C10M 2207/289* (2013.01); *C10M 2209/084* (2013.01); *C10M 2209/1033* (2013.01); *C10M 2209/104* (2013.01); *C10M 2217/06* (2013.01); *C10M 2225/04* (2013.01); *C10N 2220/022* (2013.01); *C10N 2220/082* (2013.01); *C10N 2230/06* (2013.01); *C10N 2230/54* (2013.01); *C10N 2240/02* (2013.01); *C10N 2240/04* (2013.01); *C10N 2240/06* (2013.01); *C10N 2240/10* (2013.01); *C10N 2240/105* (2013.01); *C10N 2240/204* (2013.01); *C10N 2240/30* (2013.01); *C10N 2240/52* (2013.01); *C10N 2240/66* (2013.01)

(56) References Cited

U.S. PATENT DOCUMENTS

| | | | | |
|---|---|---|---|---|
| 5,696,065 | A | 12/1997 | Tanaka et al. | |
| 6,043,200 | A * | 3/2000 | Carroll et al. | 508/332 |
| 6,548,454 | B1 | 4/2003 | Yamamoto et al. | |
| 6,878,676 | B1 | 4/2005 | Migdal et al. | |
| 2003/0130137 | A1 | 7/2003 | Imai et al. | |
| 2003/0151030 | A1 * | 8/2003 | Gurin | 252/502 |
| 2004/0242434 | A1 * | 12/2004 | Yagishita et al. | 508/291 |
| 2005/0124510 | A1 | 6/2005 | Costello et al. | |
| 2005/0261141 | A1 * | 11/2005 | Iso et al. | 508/154 |

FOREIGN PATENT DOCUMENTS

| | | | |
|---|---|---|---|
| CN | 1641004 | | 7/2005 |
| DE | 20 2004 020 067 | U1 | 3/2005 |
| DE | 10 2004 021 812 | | 12/2005 |
| EP | 0 699 738 | B1 | 12/1999 |
| JP | 8-20786 | A | 1/1996 |
| JP | 8-127789 | A | 5/1996 |
| JP | 11-246886 | A | 9/1999 |
| JP | 2000-282077 | | 10/2000 |
| JP | 2002-294272 | | 10/2002 |
| JP | 2003-105367 | | 4/2003 |
| JP | 2003-535956 | | 12/2003 |
| JP | 2005-194303 | A | 7/2005 |
| WO | WO-03/050332 | | 6/2003 |

OTHER PUBLICATIONS

Japanese Industrial Standard, "Chromium Steels," JIS G 4104, 1979, pp. 1-9.

Japanese Industrial Standard, "High carbon chromium bearing steels," JIS G 4805, 1999, pp. 1-31.

Standard Test Method for Separation of Representative Aromatics and Nonaromatics Fractions of High-Boiling Oils by Elution Chromatography, ASTM Designation: D 2549-91 (Re-approved 1995), pp. 895-900.

Office Action received in U.S. Appl. No. 12/188,048 dated May 12, 2010 (10 pgs).

Communication (Supplementary Partial European Search Report) in EP Appln 06 78 1756 dated Mar. 10, 2011.

Office Action in CN Appln No. 200680052164.2 dated Feb. 17, 2011.

Communication (EP Search Report) in EP Appln No. 11007962.1 dated Nov. 23, 2011.

Kano, M., et al. "Utlralow friction of DLC in presence of glycerol mono-oleate (GMO)", Tribiology Letters, Feb. 2005, vol. 18, No. 2, pp. 245-251.

Qiao, Y., et al. "High temperature tribiological behaviors of nano-diamond as oil additive", J. Cent. South Univ. Technol., Oct. 2005, vol. 12, Suppl 2, pp. 181-185.

Office Action received in U.S. Appl. No. 12/188,048 Aug. 6, 2013

Response to European Search Report, Application No. 11007962.1-2104 dated May 24, 2012.

Response to First European Office Action, Application No. 11007962.1-2104 dated Jan. 21, 2013.

Response to Second European Office Action, Application No. 11007962.1-2104 dated Jul. 19, 2013.

* cited by examiner

NANOPARTICLE-CONTAINING LUBRICATING OIL COMPOSITIONS

RELATED APPLICATION

This application is a national stage entry of PCT/JP2006/314845, filed Jul. 27, 2006, which claims priority from Japanese Patent Application No. 2006-022268, filed Jan. 31, 2006, which are incorporated by reference in their entirety.

TECHNICAL FIELD

This invention relates to a nanoparticle-containing lubricating oil composition applicable to a sliding section, and more specifically to a nanoparticle-containing lubricating oil composition which is applied to sliding parts widely applied to an internal combustion engine and capable of reducing a friction coefficient.

BACKGROUND ART

Global environmental problems such as global warming, ozone layer destruction and the like are coming to the fore. As it has been said that the global warming is significantly affected by $CO_2$ emission, the reduction of $CO_2$ emission, notably the setting of $CO_2$ emission standards, has become a big concern to each country.

One of challenges to reduce $CO_2$ emission is to improve a fuel economy of automotive vehicles, in which lubricating oils play an important role.

As fuel economy improving measures in connection with lubricating oil, the following approaches have been proposed: (1) lowering the viscosity of the lubricating oil, thereby reducing viscous resistance in hydrodynamic lubrication regions and agitation resistance in the engine; and (2) adding an optimum friction modifier and a variety of additives into the lubricating oil so as to reduce a friction loss under the conditions of mixed lubrication and boundary lubrication. Many studies have been made on various friction modifiers including organomolybdenum compounds, such as molybdenum dithiocarbamate (MoDTC) and molybdenum dithiophosphate (MoDTP). As a result of the studies, the lubricating oil containing an organomolybdenum compound which successfully exhibits a low friction coefficient at the early stage of use is applied on a sliding surface formed of a conventional steel material, exhibiting a good effect (See Patent Literature 1).

Patent Literature 1: Japanese Patent Provisional Publication No. 8-20786.

DISCLOSURE OF THE INVENTION

Problems to be Solved by the Invention

However, even the lubricating oil described in the above-mentioned Patent Literature 1 is insufficient in effect against a recently required further fuel economy, and therefore a further lowering in friction coefficient has been desired.

The present invention has been made in view of such problems in conventional techniques and has an object to provide a nanoparticle-containing lubricating oil composition which is capable of exhibiting a low friction coefficient and realizing a further fuel economy characteristics.

Means for Solving the Problems

As a result of eagerly conducted many researches and developments in order to attain the above-mentioned objects, the present inventors have found to attain the above-mentioned objects by adding an additive (oxygen-containing additive) having hydroxyl group and nanoparticle into a base oil, thereby reaching the completion of the present invention.

In other words, the nanoparticle-containing lubricating oil composition of the present invention comprises a base oil, an additive containing hydroxyl group, and nanoparticle.

Here, a mechanism for lowering a friction coefficient in the present invention, assumed at the present time will be discussed.

Particle (nanoparticle) of a nanometer order is large in rate of surface area to volume and therefore high in surface energy as a system. When such particle is dispersed in a liquid, it tends to readily disperse so as to hardly sediment.

Though discussed in detail after, nanoparticle of metal oxide and metal carbide is high in surface energy and therefore tends to readily adsorb an additive having hydroxyl group. Additionally, nanoparticle whose main component element is carbon basically does not contain hydrogen within the particle, and therefore the nanoparticle tends to readily adsorb the additive having hydroxyl group under the action of free dangling bond of the nanoparticle.

Upon a contact (metal contact) between the sliding surfaces of metals, a metal adhesion occurs. Additionally, by a friction generated owing to a high shear stress during sliding, the nanoparticle adsorbing the additive having hydroxyl group as discussed above is caught up in a sliding section between the sliding surfaces, so that a tribo-film is formed from the nanoparticle. Then, the friction is replaced with a friction generated owing to a low shear stress through the tribo-film during further sliding, thereby achieving a sharp friction reduction.

Effects of the Invention

According to the present invention, the additive having hydroxyl group and nanoparticle are added to a base oil, and therefore it is possible to provide a nanoparticle-containing lubricating oil composition which allows to exhibit a low friction coefficient and realizes a further fuel economy.

THE BEST MODE FOR CARRYING OUT THE INVENTION

Hereinafter, a nanoparticle-containing lubricating oil composition of the present invention will be discussed in detail. In the specification and the claims of the present application, "%" represents % by mass unless otherwise specified.

As discussed above, the nanoparticle-containing lubricating oil composition of the present invention comprises a base oil, an additive having hydroxyl group, and nanoparticle.

By taking such an arrangement, when the nanoparticle-containing lubricating oil composition is used for a steel product which is widely used for sliding parts of an internal combustion engine, a friction coefficient can be significantly reduced while realizing a fuel economy.

Additionally, by using the nanoparticle-containing lubricating oil composition of the present invention, the friction coefficient can be significantly lowered while realizing a fuel economy, without necessity of conducting a surface treatment such as a plating or a thin film formation to a sliding part to which the composition is applied, without necessity of adding an additive of an organic molybdenum compound such as MoDTC to the lubricating oil, and without conducting such a surface treatment and addition of the organic molybdenum compound.

Furthermore, the nanoparticle-containing lubricating oil composition of the present invention is preferably used for contacting surfaces of parts which are opposite to each other and make a relative motion to each other, each of the parts being formed of an iron-based metal material. Additionally, the nanoparticle-containing lubricating oil composition can be applied for contacting surfaces of parts each of which is formed of an aluminum alloy.

The "contacting surfaces which are opposite to each other and make a relative motion to each other" means a variety of contacting surfaces which make a relative motion to each other, such as sliding surfaces, rotating surfaces, rolling surfaces, upon one or both of the opposite surfaces making a motion.

The lubricating oil composition of the present invention can be used for a mechanism or a system which has contacting surfaces which are opposite to each other and make a relative motion to each other, for example, an internal combustion engine such as a four-stroke cycle engine, a two-stroke cycle engine or the like, more specifically a valve operating system, a piston, a piston ring, a piston skirt, a cylinder liner, a connecting rod, a crankshaft, a bearing, a roller bearing, a bearing metal or insert, a gear, a chain, a belt, an oil pump and the like; a driving system transmission mechanism, for example, a gear or the like; a driving section of a hard disc drive having contacting surfaces; an air conditioner having a compressor; a motor and its bearing; an artificial joint for a living body; a medical instrument; measuring meters such as a watch and the like; and a mechanism having various contacting surfaces which are in a severe frictional condition and required to have a low friction characteristics.

Particularly when the lubricating oil composition of the present invention is supplied to a system of the closed-type, the recirculation-type or the like and then the system is operated, a fuel economy effect is demonstrated.

The above-mentioned iron-based metal material is not particularly limited to a high purity iron, and therefore a variety of iron-based alloys and the like containing, for example, carbon, nickel, copper, zinc, chromium, cobalt, molybdenum, lead, silicon or titanium, or any combination of the aforementioned elements may be used.

Specifically, examples of the iron-based metal material are carburized SCM 420 steel (Japanese Industrial Standard) and SCr 420 steel (Japanese Industrial Standard).

First, the base oil used in the present invention will be discussed.

In the present invention, a mineral oil or a synthetic oil may be used as the base oil, in which the base oil is preferably a main component of the nanoparticle-containing lubricating oil composition. The "main component" means a component occupying not less than 50% based on the whole amount of the lubricating oil composition.

Specific examples of the above-mentioned mineral oil are paraffin-based or naphthene-based oil, normal paraffin and the like, prepared by extracting a lubricating oil fraction from petroleum by atmospheric or reduced-pressure distillation, and then, purifying the obtained lubricating oil fraction by using, in suitable combination, purification treatments such as solvent deasphalting, solvent extraction, hydrocracking, solvent dewaxing, hydrogenation purification, sulfuric acid washing, clay treatment and the like.

General examples are ones obtained by using solvent purification or hydrogenation purification; however, preferable examples are ones produced by using high-hydrocracking process which is capable of largely decreasing aromatic components, or by using a process for isomerizing GTL Wax (gas to liquid wax).

Specific examples of the above-mentioned synthetic oil are alkylnaphthalene, alkylbenzene, polybutene and their hydrides; poly-α-olefin such as 1-octene oligomer, 1-decene oligomer and the like, and hydrides of poly-α-olefin; diesters such as tridecyl glutarate, dioctyl adipate, diisodecyl adipate, ditridecyl adipate, dioctyl sebacate and the like; polyol esters such as trimethylolpropane caprylate, trimethylolpropane pelargonate, pentaerythritol-2-ethyl hexanoate, pentaerythritol pelargonate, and the like; polyoxyalkylene glycol (PAG); polyvinyl ether (PVE); and their mixtures and the like. As greases of lubricating oils, diester oil, poly-α-olefin, polyol ester oil, polyalkylene glycol, silicone oil and fluorine oil may be used.

Preferable examples of the above-mentioned polyα-olefin based base oil are preferably α-olefins having a carbon number of 2 to 30, more preferably polymers, copolymers and hydrides of α-olefins having a carbon number of 8 to 16. Particularly preferable examples are poly-α-olefins such as 1-octene oligomer, 1-decene oligomer and the like, and hydrides of poly-α-olefins.

In the present invention, the above-mentioned mineral oil or synthetic oil may be used alone, or in the form of a mixture of two or more kinds of the mineral oil or synthetic oil.

Additionally, a mixture ratio of the two or more kinds in the above-mentioned mixture may be also not particularly restricted and may be freely selectable.

A total aromatic content of the above-mentioned base oil is also not particularly restricted. The total aromatic content is preferably 15% or less, more preferably 10% or less, and most preferably 8% or less.

Additionally, the total aromatic content of the base oil containing the above-mentioned poly-α-olefin based base oil is preferably not more than 5%, more preferably not more than 3%, and particularly preferably not more than 2%.

Here, the total aromatic content means a content of aromatics fraction determined according to ASTM D2549, and such aromatics fraction ordinarily contains alkylbenzene, alkylnaphthalene, anthracene, phenanthrene, alkylated substances thereof, a compound in which four or more benzene rings are condensed, and compounds containing heteroaromatic structures such as pyridines, quinolines, phenols, naphthols, and the like.

In case that the total aromatic content of the base oil exceeds 15%, an oxidation stability is inferior, and therefore such a case is not preferable.

Additionally, in case of using a highly hydrocracked mineral oil, 1-decene oligomer hydride or the like as the base oil, the composition high in friction lowering effect can be obtained even if the total aromatic content of the base oil is not more than 2% or 0%.

For example, in case that the content of a fatty acid ester-based ashless friction modifier in the base oil exceeds 1.4%, the base oil may be inferior in storage stability, and therefore it is preferable to mix a solvent-refined mineral oil, alkyl benzene or the like into the base oil as occasion demands so as to regulate the total aromatic content of the base oil to, for example, not less than 2%.

The kinematic viscosity of the above-mentioned base oil is not particularly restricted. When the lubricating oil composition is used for an internal combustion engine, the kinematic viscosity of the base oil at 100° C. is preferably 2 $mm^2/s$ or higher, more preferably 3 $mm^2/s$ or higher.

Additionally, the kinetic viscosity is preferably 20 $mm^2/s$ or lower, more preferably 10 $mm^2/s$ or lower, most preferably 8 $mm^2/s$ or lower.

Setting the kinetic viscosity at 100° C. at 2 $mm^2/s$ or higher can provide the lubricating oil composition which can form a sufficient oil film, is excellent in lubrication and considerably low in evaporation loss of the base oil at high temperature conditions.

Setting the kinetic viscosity at 100° C. at 20 $mm^2/s$ or lower can provide the lubricating oil composition which is considerably low in friction resistance in a lubricated site because a flow resistance is low.

The viscosity index of the base oil is not particularly restricted, and is preferably 80 or higher. When the lubricating oil is used for an internal combustion engine, the viscosity index is preferably 100 or more, and more preferably 120 or more.

Selecting the base oil having a high viscosity index can provide the lubricating oil composition which is not only excellent in low temperature viscosity characteristics but also excellent in friction lowering effect.

Next, the additives used in the present invention will be discussed.

As discussed above, the nanoparticle-containing lubricating oil composition is required to contain the additive having hydroxyl group.

Here, examples of the additive having hydroxyl group are an ashless friction modifier and the like.

Additionally, the nanoparticle-containing lubricating oil composition of the present invention may be mixed with additives such as a viscosity index improver, a pour point depressant, a friction preventing agent, an extreme pressure agent, a friction modifier, a detergent-dispersant, an antioxidant, an antirusting agent, a metal deactivator, a surface active agent, an antiemulsifier agent, a seal swelling agent, a defoaming agent and a coloring agent, or with any combination of the above-mentioned additives.

It is preferable that a whole or a part of the above-mentioned additive having hydroxyl group is the ashless friction modifier. Examples of such an additive are a fatty acid-based friction modifier, and the like.

Examples of the above-mentioned fatty acid ester-based ashless friction modifier are esters and the like which are formed from a fatty acid having hydrocarbon group having a carbon number of 6 to 30 and a monohydric alcohol or an aliphatic polyhydric alcohol.

Specific preferable examples of the fatty acid ester-based ashless friction modifier are glycerol monooleate, glycerol dioleate, sorbitan monooleate, sorbitan dioleate and the like.

Specific examples of the above-mentioned straight or branched hydrocarbon group having a carbon number of 6 to 30 are alkyl groups, such as hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, icosyl group, heneicosyl group, docosyl group, tricosyl group, tetracosyl group, pentacosyl group, hexacosyl group, heptacosyl group, octacosyl group, nonacosyl group, triacontyl group and the like; and alkenyl groups, such as hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, icosenyl group, heneicosenyl group, docosenyl group, tricosenyl group, tetracosenyl group, pentacosenyl group, hexacosenyl group, heptacosenyl group, octacosenyl group, nonacosenyl group, triacontenyl group and the like. The above alkyl groups and alkenyl groups include all possible straight chain structures and branched structures. Additionally, the position of double bond of alkenyl groups is free.

In the present invention, the content of the fatty acid ester-based ashless friction modifier is not particularly restricted, in which the content is preferably 0.05 to 3.0%, more preferably 0.1 to 2.0% and most preferably 0.5 to 1.4%, based on the total amount of the lubricating oil composition.

If the above content is less than 0.05%, a friction lowering effect tends to become less. If the content exceeds 3.0%, the friction lowering effect is excellent; however, the solubility of the ashless friction modifier to the lubricating oil and a storage stability of the ashless friction modifier are remarkably deteriorated so that a precipitate tends to be readily formed, which is not preferable.

In the present invention, examples of the viscosity index improver are non-dispersion type viscosity index improvers, such as copolymers of various methacrylic acids or of any combination of the various methacrylic acids, and hydrides of the copolymers; and dispersion type viscosity index improvers, such as copolymers of various methacrylate esters containing nitrogen compounds; and the like.

The examples may be non-dispersion type or dispersion type ethylene-α-olefin copolymers (α-olefin is, for example, propylene, 1-butene, 1-pentene or the like) and hydrides thereof, polyisobutylenes and hydrides thereof, a hydrogenated copolymer of styrene and diene, a copolymer of styrene and maleic anhydride, polyalkylstyrenes, and the like.

The molecular weight of the viscosity index improver is required to be selected taking account of shear stability. Specifically, the number-average molecular weight of the viscosity index improver is in a range of 5,000 to 1,000,000, preferably 100,000 to 800,000, for dispersion or non-dispersion type polymethacrylates; and in a range of 800 to 5,000 for polyisobutylenes or hydrides thereof; and in a range of 800 to 300,000, preferably 10,000 to 200,000 for ethylene-α-olefin copolymers and hydrides thereof.

Additionally, such viscosity index improvers can be used alone or in any combination of a plurality of kinds thereof. The content of the viscosity index improver is ordinarily preferably 0.1 to 40.0% based on the mass of the lubricating oil composition.

In the lubricating oil composition of the present invention, it is particularly preferable to use the polymethacrylate-based viscosity index improver of the above-mentioned viscosity index improvers, from the viewpoint of maintaining a low friction characteristics.

Next, the nanoparticle used in the present invention will be discussed.

In the present invention, the nanoparticle is required to have a particle diameter of the nano order, and specifically to have a particle diameter of 1 to 100 nm, in which the particle diameter is preferably 1 to 50 nm and more preferably 1 to 10 nm.

A nanoparticle particle diameter outside the above range is not preferable because of resulting in abrasion.

In the present invention, the nanoparticle is preferably contained in an amount of 0.1 to 0.6 part by weight and more preferably 0.3 to 0.5 part by weight, based on 100 parts by weight of total of the base oil and additive(s).

Here, the "additive(s)" is not restricted to the additive having hydroxyl group, and therefore includes all additives which are mixed as occasion demands.

Additionally, in the lubricating oil composition of the present invention, the nanoparticle is contained preferably in an amount of 0.05 to 3% and more preferably in an amount of 0.3 to 0.5%.

In case that the content of the nanoparticle is less than 0.05%, a remarkable lowering in friction coefficient cannot be recognized, which is not preferable. In case that the content of the nanoparticle exceeds 3%, a viscosity increases thereby raising a friction coefficient, which is not preferable.

Additionally, in the present invention, it is preferable that all or a part of the nanoparticle to be used is oxide or carbide.

Examples of the above-mentioned oxide are aluminum oxide, titanium oxide, cerium oxide, yttrium oxide, zinc oxide, tin oxide, copper oxide, holmium oxide, bismuth oxide, cobalt oxide, iron oxide, manganese oxide, and metal oxide mixtures prepared by suitably mixing the above metal oxides; nonmetal oxides such as silicon oxide and the like; and mixtures prepared by metal oxide(s) and nonmetal oxide(s).

Additionally, examples of the above-mentioned carbide are metal carbides such as vanadium carbide, tungsten carbide, titanium carbide and the like; and nonmetal carbides such as silicon carbide and the like.

As discussed above, the metal oxide or the metal carbide can demonstrate an excellent friction lowering effect, in which aluminum oxide exhibits a particularly excellent friction lowering effect.

Additionally, it is preferable that all or a part of the nanoparticle is formed of a carbon material whose main component is carbon.

Examples of such a carbon material are soot (and carbon black as an aggregated body of soot), DLC (diamond-ike carbon), diamond, and the like. Such carbon materials may be suitably mixed. Additionally, the hydrogen content of DLC is preferably as low as possible, and specifically not more than 10 atomic % and more preferably not more than 5 atomic %, and further more preferably not more than 1 atomic %.

Additionally, in the present invention, in case that the nanoparticle to be used is formed of diamond, the nanoparticle is preferably of single crystal.

In case that the nanoparticle formed of diamond is of single crystal, amorphous carbon (existing at grain boundary of a polycrystalline body or an aggregated body) does not exist in a surface layer, and therefore the additive having hydroxyl group tends to be further readily adsorbed to the nanoparticle under the action of dangling bond in a surface layer of $sp^3$ structure.

Further, in the present invention, in case that the nanoparticle to be used is formed of diamond, the particle diameter of the nanoparticle is preferably not larger than 10 nm.

In case that the particle diameter of the nanoparticle formed of diamond is not larger that 10 nm, the rate of surface area increases thereby accelerating the adsorption.

Furthermore, two or more kinds of the nanoparticles of the above-mentioned oxide, carbide and the carbon material are used upon being mixed with each other.

As the nanoparticle of the above-mentioned oxide, carbide and/or carbon material, the nanoparticle may be used in a condition of being dispersed in a solvent. Examples of such a solvent are water, alcohol such as ethanol and the like, dimethyl sulfoxide (DMSO), methylisobutyl ketone (MIBK), xylene, toluene, terpineol, butyl carbitol, and the like. It is preferable to mix a nonionic surface active agent when the nanoparticle is dispersed in the lubricating oil. Specifically, as a dispersing solvent (dispersing agent) for dispersing the nanoparticle, polyoxyethylenealkyl ether, or a mixture prepared by mixing polyoxyethylenealkyletherphosphate with polyoxyethylenealkyl ether are most preferable. Additionally, as the dispersing agent, polyoxyethylenedialkylphenyletherphosphate, or a mixture prepared by mixing polyoxydialkylphenyl ether with polyoxyethylenedialkylphenyletherphosphate may be used. In order to disperse fine particle, it is required to form micelle by using a dispersing agent or a surface active agent. In other words, a steric hindrance effect is provided to the particle. By this, aggregation of the fine particle due to van der Waals force can be prevented. Particularly in case that particles having particle diameters of several nanometers are completely dispersed, a liquid becomes transparent.

Additionally, examples of the oxide capable of being dispersed in the solvent are aluminum oxide, zinc oxide, titanium oxide, silicon oxide, tin oxide, cerium oxide, copper oxide, yttrium oxide and the like.

When the nanoparticle is dispersed in the solvent, it is preferable that the concentration of the nanoparticle is within a range of 5 to 20%. Particularly in case that alumina is dispersed in toluene, aggregation among particles cannot occur, which has been recognized to be effective.

EXAMPLES

Hereinafter, the present invention will be discussed further in detail with reference to Examples and Comparative Examples; however, the present invention is not limited to these Examples.

Examples 1-24 and Comparative Examples 1-10

Nanoparticle-containing lubricating oil compositions of respective Examples were prepared as shown in Table 1, Table 2 and Table 3 (however, nanoparticle was not contained in Comparative Example 5). A content of a component in Tables is represented with % by mass. In Tables, alumina to diamond B are nanoparticles.

Here, as "poly-α-olefin (PAO)" in Tables, PAO4 having a kinetic viscosity of 4 $mm^2/s$ at 100° C. was used.

Additionally, as a "viscosity index improver", dispersion type PMA (polymethacrylate) was used (this viscosity index improver had a nitrogen-containing polar group and did not have hydroxyl group).

Further, as an "ashless friction modifier", GMO (glycerin monooleate) was used (this viscosity index improver has hydroxyl group).

Furthermore, as a "diamond A", commercially available cluster diamond (having a particle diameter of 15 nm) was used.

Here, as a "PAO" in Tables, poly-alpha-olefin was used.

Furthermore, as a "diamond B", one which had been prepared by pulverizing the commercially available cluster diamond (the diamond A) by a ball mill and extracted in a dispersed state without being aggregated by using a dispersing solvent was used (the particle diameter was 3-5 nm).

TABLE 1

| | EXAMPLE 1 | EXAMPLE 2 | EXAMPLE 3 | EXAMPLE 4 | COMPARATIVE EXAMPLE 1 | EXAMPLE 5 | COMPARATIVE EXAMPLE 2 | EXAMPLE 6 | COMPARATIVE EXAMPLE 3 | EXAMPLE 7 | EXAMPLE 8 | COMPARATIVE EXAMPLE 4 |
|---|---|---|---|---|---|---|---|---|---|---|---|---|
| BASE OIL | | | | | | | | | | | | |
| PAO | 93.62 | 93.8 | 93.5 | 91.8 | 90.4 | 93.62 | 93.99 | 93.62 | 90.4 | 93.62 | 93.62 | 93.96 |
| PAG | | | | | | | | | | | | |
| ADDITIVE | | | | | | | | | | | | |
| VISCOSITY INDEX IMPROVER | 5 | 5 | 5 | 5 | 5 | 5 | 5 | 5 | 5 | 5 | 5 | 5 |
| ASHLESS FRICTION MODIFIER | 1 | 1 | 1 | 1 | 1 | 1 | 1 | 1 | 1 | 1 | 1 | 1 |
| DISPERSING SOLVENT | | | | | | | | | | | | |
| ALUMINA | 0.38 | 0.20 | 0.50 | 2.20 | 3.60 | | | | | | | |
| SOOT | | | | | | 0.38 | 0.01 | | | | | |
| VANADIUM CARBIDE | | | | | | | | 0.38 | 3.6 | | | |
| DLC | | | | | | | | | | 0.38 | | |
| DIAMOND A | | | | | | | | | | | 0.38 | 0.04 |
| DIAMOND B | | | | | | | | | | | | |
| PERFORMANCE TEST RESULT μ | 0.089 | 0.095 | 0.082 | 0.11 | 0.153 | 0.092 | 0.12 | 0.093 | 0.142 | 0.088 | 0.09 | 0.118 |
| REMARKS | | | | | ※ | | | | ※ | | | ※ |

※ ROUGHNESS DEGRADED DUE TO SEVERE ABRASION

TABLE 2

| | EXAMPLE 9 | EXAMPLE 10 | COMPARATIVE EXAMPLE 5 | COMPARATIVE EXAMPLE 6 | COMPARATIVE EXAMPLE 7 | COMPARATIVE EXAMPLE 8 | COMPARATIVE EXAMPLE 9 | COMPARATIVE EXAMPLE 10 | EXAMPLE 11 | EXAMPLE 12 | EXAMPLE 13 | EXAMPLE 14 |
|---|---|---|---|---|---|---|---|---|---|---|---|---|
| BASE OIL | | | | | | | | | | | | |
| PAO | 93.949 | 93.925 | 94 | 94.62 | 94.62 | 94.62 | 94.62 | 94.62 | 83 | 83 | 93.45 | 92.9 |
| PAG | | | | | | | | | | | | |
| ADDITIVE | | | | | | | | | | | | |
| VISCOSITY INDEX IMPROVER | 5 | 5 | 5 | 5 | 5 | 5 | 5 | 5 | 5 | 5 | 5 | 5 |
| ASHLESS FRICTION MODIFIER | 1 | 1 | 1 | | | | | | 1 | 1 | 1 | 1 |
| DISPERSING SOLVENT | | | | | | | | | ETHANOL 10 | DMSO 10 | ETHANOL 0.5 | ETHANOL 1 |
| ALUMINA | | 0.075 | | 0.38 | | | | | | | | |
| SOOT | | | | | 0.38 | | | | | | | |
| VANADIUM CARBIDE | | | | | | 0.38 | | | | | | |
| DLC | | | | | | | 0.38 | | | | | |
| DIAMOND A | 0.051 | | | | | | | 0.38 | | | | |
| DIAMOND B | | | | | | | | | 1 | 1 | 0.05 | 0.1 |
| PERFORMANCE TEST RESULT μ | 0.092 | 0.111 | 0.118 | 0.135 | 0.138 | 0.136 | 0.139 | 0.136 | 0.05 | 0.05 | 0.07 | 0.053 |
| REMARKS | | | | | | | | | | * DMSO: DIMETHYL SULFOXIDE | | |

TABLE 3

| | EXAMPLE 15 | EXAMPLE 16 | EXAMPLE 17 | EXAMPLE 18 | EXAMPLE 19 | EXAMPLE 20 | EXAMPLE 21 | EXAMPLE 22 | EXAMPLE 23 | EXAMPLE 24 |
|---|---|---|---|---|---|---|---|---|---|---|
| BASE OIL | | | | | | | | | | |
| PAO | 88.5 | 93.5 | 93.5 | 92.95 | 92.95 | 91.7 | 91.6 | | | |
| PAG | | | | | | | | 92.7 | 92.5 | 93.95 |

TABLE 3-continued

| | EXAMPLE 15 | EXAMPLE 16 | EXAMPLE 17 | EXAMPLE 18 | EXAMPLE 19 | EXAMPLE 20 | EXAMPLE 21 | EXAMPLE 22 | EXAMPLE 23 | EXAMPLE 24 |
|---|---|---|---|---|---|---|---|---|---|---|
| ADDITIVE | | | | | | | | | | |
| VISCOSITY INDEX IMPROVER | 5 | 5 | 5 | 5 | 5 | 5 | 5 | 5 | 5 | 5 |
| ASHLESS FRICTION MODIFIER | 1 | 1 | 1 | 1 | 1 | 1 | 1 | | | |
| DISPERSING SOLVENT | ETHANOL | (POWDER) | (POWDER) | A (MENTIONED BELOW) | B (MENTIONED BELOW) | C (MENTIONED BELOW) | D (MENTIONED BELOW) | A (MENTIONED BELOW) | B (MENTIONED BELOW) | C (MENTIONED BELOW) |
| | 5 | 0 | 0 | 1 | 1 | 2 | 2 | 2 | 2 | 1 |
| ALUMINA | | | | | | | | | | |
| SOOT | | | | | | | | | | |
| VANADIUM CARBIDE | | | | | | | | | | |
| DLC | | | | | | | | | | |
| DIAMOND A | | | 0.5 | | | | | | | |
| DIAMOND B | 0.5 | 0.5 | | 0.05 | 0.05 | 0.3 | 0.4 | 0.3 | 0.5 | 0.05 |
| PERFORMANCE TEST RESULT μ | 0.054 | 0.07 | 0.08 | 0.047 | 0.048 | 0.045 | 0.043 | 0.052 | 0.054 | 0.063 |
| REMARKS | | NOTE 1 | NOTE 1 | NOTE 2 | NOTE 2 | NOTE 2 | NOTE 2 | NOTE 2 | NOTE 2 | NOTE 2 |

NOTE 1:
POWDER WAS EXTRACTED AS POWDER BY EVAPORATING ETHANOL OF ETHANOL-DISPERSED PARTICLE.
NOTE 2:
THE POWDER OBTAINED IN NOTE 1 WAS AGAIN DISPERSED IN AN INDICATED
DISPERSING SOLVENT THEREBY IMPROVING A DISPERSION CHARACTERISTICS TO THE BASE OIL.
DISPERSING SOLVENT A: 15% OF POLYOXYETHYLENEALKYL ETHER AND 85% OF POLYOXYALKYLETHERPHOSPHATE
DISPERSING SOLVENT B: 15% OF POLYOXYETHYLENEALKYLPHENYL ETHER AND 85% OF POLYOXYETHYLENEALKYLPHENYLETHERPHOSPHATE
DISPERSING SOLVENT C: 5% OF POLYOXYETHYLENEALKYL ETHER AND 95% OF POLYOXYETHYLENEALKYLETHERPHOSPHATE
DISPERSING SOLVENT D: 5% OF POLYOXYETHYLENEALKYLPHENYL ETHER AND 95% OF POLYOXYETHYLENEALKYLPHENYLETHERPHOSPHATE

[Performance Test]

(Production of Test Piece)

Test pieces for a SRV testing machine produced by Optical Instruments Prüftechnik GmbH was produced as an example of a low friction motion system having contacting surfaces. A disc material and a cylinder material as the test pieces were respectively formed by grinding from heat treated SUJ2 materials (according to Japanese Industrial Standard), and thereafter they were respectively grinded by using a lapping tapes thereby being finished at a certain surface roughness (Ra=not larger than 0.2 μm). The specifications of the obtained test pieces are shown in Table 4.

TABLE 4

| | Base material | Dimension | Surface hardness Hv | Surface roughness (μm) |
|---|---|---|---|---|
| Disc | Heat treated SUJ2 material | Diameter: 24 mm, thickness: 7.9 mm | 1800 | 0.04 |
| Cylinder | Heat treated SUJ2 material | Diameter: 15 mm, width: 22 mm | 750 | 0.05 |

(SRV Friction Test)

The obtained test pieces were set on the SRV testing machine produced by Optical Instruments Prüftechnik GmbH, and then each of nanoparticle-containing lubricating compositions shown in Table 1, Table 2 and Table 3 were dropped onto the test pieces, in which friction coefficients during a time period of from 10 minutes to 20 minutes were measured under a test condition as set forth below. Obtained results of are also shown in Table 1, Table 2 and Table 3.

During the time period of from 10 minutes to 20 minutes after the initiation of the test, the most stable friction coefficients were demonstrated, and therefore the friction coefficients were evaluated.

(Test Condition)

Temperature: 80° C.

Load: 400N

Amplitude: 3 mm

Frequency: 50 Hz

FIG. 1 is a perspective explanatory view showing the outline of SRV friction testing machine. As shown in the same FIGURE, a cylinder 11 is disposed on a disc 10. An arrow A indicates the direction (from an upper side to a lower side) of a load applied during the friction test, while an arrow B indicates a direction (horizontal direction) in which the cylinder 11 slidingly move on the surface of the disc 10.

From Table 1, Table 2 and Table 3, it has been confirmed that the nanoparticle-containing lubricating oil compositions belonging within the scope of the present invention can lower a friction coefficient and exhibit stable friction lowering effects as compared with the nanoparticle-containing lubricating oil compositions or the lubricating oil compositions outside the scope of the present invention.

Additionally, at the present time, it is assumed that Example 14 provides the best result from the viewpoint of friction lowering effect and economical efficiency.

INDUSTRIAL USABILITY

The lubricating oil composition of the present invention can be applied without restriction to contacting surfaces which are opposite to each other and make a relative motion to each other, of various machines and apparatuses which require a low friction performance. Additionally, the lubricating oil composition can widely contribute to energy saving measures throughout a variety of fields.

EXPLANATION OF REFERENCE NUMERALS

Figure 1:
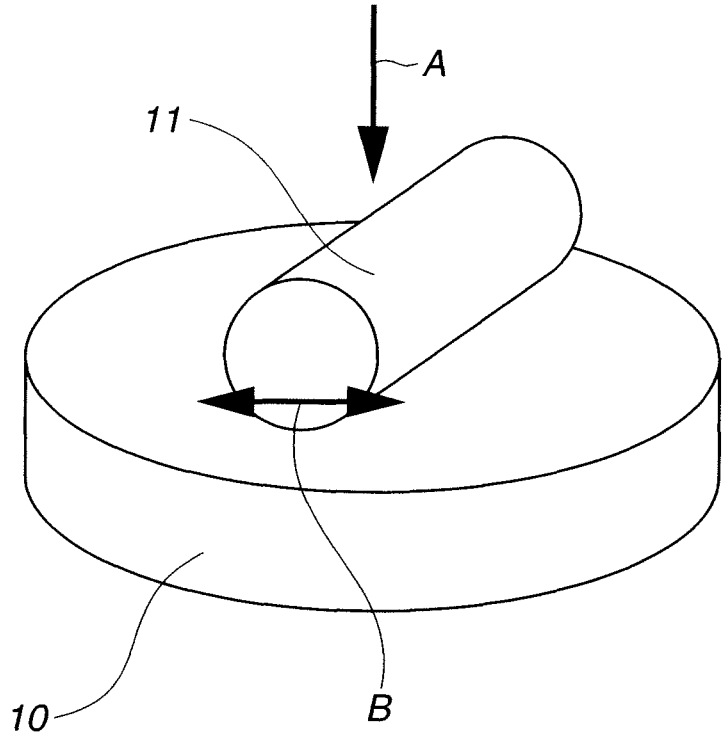
FIG. 1 is a perspective explanatory view showing the outline of a SRV friction testing machine.

10 disc
11 cylinder

The invention claimed is:

1. A nanoparticle-containing lubricating oil composition comprising a base oil, an oxygen-containing additive, a dispersing solvent, a viscosity index improver, and nanoparticles, wherein the base oil is a poly-α-olefin and is contained in an amount of at least 50% by mass based on the total amount of the lubricating oil composition, wherein the oxygen-containing additive is a fatty acid ester-based ashless friction modifier having hydroxyl groups and is contained in an amount ranging from 0.05 to 3% by mass based on the total amount of the lubricating oil composition, wherein the dispersing solvent is contained in an amount of 0.5 to 10% by mass based on the total amount of the lubricating oil composition and includes a nonionic surface active agent, wherein the viscosity index improver is contained in an amount ranging from 0.1 to 5% by mass based on the total amount of the lubricating oil composition, wherein the nanoparticles consist essentially of diamond nanoparticles having a particle diameter of 3 to 5 nm and are contained in an amount ranging from 0.05 to 1% by mass based on the total amount of the lubricating oil composition, and wherein the surface active agent includes polyoxyethylenealkyl ether in an amount ranging from 5 to 15%, and polyoxyethylenealkyletherphosphate in an amount ranging from 85 to 95%.

2. A nanoparticle-containing lubricating oil composition comprising a base oil, an oxygen-containing additive, a dispersing solvent, a viscosity index improver, and nanoparticles, wherein the base oil is a poly-α-olefin and is contained in an amount of at least 50% by mass based on the total amount of the lubricating oil composition, wherein the oxygen-containing additive is a fatty acid ester-based ashless friction modifier having hydroxyl groups and is contained in an amount ranging from 0.05 to 3% by mass based on the total amount of the lubricating oil composition, wherein the dispersing solvent is contained in an amount of 0.5 to 10% by mass based on the total amount of the lubricating oil composition and includes a nonionic surface active agent, wherein the viscosity index improver is contained in an amount ranging from 0.1 to 5% by mass based on the total amount of the lubricating oil composition, wherein the nanoparticles consist essentially of diamond nanoparticles having a particle diameter of 3 to 5 nm and are contained in an amount ranging from 0.05 to 1% by mass based on the total amount of the lubricating oil composition, and wherein the surface active agent is a mixture of polyoxyethylenedialkylphenyl ether and polyoxyethylenealkylphenylphosphate.

3. A nanoparticle-containing lubricating oil composition as claimed in claim 2, wherein the surface active agent includes polyoxyethylenedialkylphenyl ether in an amount ranging from 10 to 15%, and polyoxyethylenealkylphenylphosphate in an amount ranging from 85 to 90%.

4. A nanoparticle-containing lubricating oil composition comprising an oxygen-containing base oil, an oxygen-containing additive, a dispersing solvent, a viscosity index improver, and nanoparticles, wherein the oxygen-containing base oil is a poly-a-olefin and is contained in an amount of at least 50% by mass based on the total amount of the lubricating oil composition, wherein the nanoparticles are formed of diamond with a particle diameter of 3 to 5 nm and are contained in an amount ranging from 0.05 to 1% by mass based on the total amount of the lubricating oil composition, wherein the viscosity index improver is contained in an amount ranging from 0.1 to 5% by mass based on the total amount of the lubricating agent, wherein the oxygen-containing additive is an ashless friction modifier having hydroxyl groups and is contained in an amount ranging from 0.05 to 3% by mass based on the total amount of the lubricating oil composition, wherein the dispersing solvent includes a nonionic surface active agent and is contained in an amount of 0.5 to 10% by mass based on the total amount of the lubricating oil composition, wherein the surface active agent is a mixture of polyoxyethylenedialkylphenyl ether and polyoxyethylenealkylphenylphosphate, and wherein the surface active agent includes polyoxyethylenedialkylphenyl ether in an amount ranging from 10 to 15% and polyoxyethylenealkylphenylphosphate in an amount ranging from 85 to 90%.

* * * * *